US005184440A

United States Patent [19]

Felix et al.

[11] Patent Number: 5,184,440

[45] Date of Patent: Feb. 9, 1993

[54] METAL FRAMED FACADE PANEL AND FACADE COVERED WITH SUCH A PANEL

[76] Inventors: André Felix, Route de Berne 25, CH - 1010 Lausanne; Laurent Felix, Chemin des Combes 45, CH - 1082 Corseaux, both of Switzerland

[21] Appl. No.: 675,897

[22] PCT Filed: Sep. 4, 1990

[86] PCT No.: PCT/CH90/00206

§ 371 Date: May 2, 1991

§ 102(e) Date: May 2, 1991

[87] PCT Pub. No.: WO91/03617

PCT Pub. Date: Mar. 21, 1991

[30] Foreign Application Priority Data

Sep. 4, 1989 [FR] France ..... 89 11686
Sep. 4, 1989 [FR] France ..... 89 11687

[51] Int. Cl.[5] ..... E04B 2/00

[52] U.S. Cl. ..... 52/235; 52/475; 52/476; 52/477; 52/308; 52/656.9

[58] Field of Search ..... 52/235, 475, 476, 477, 52/656, 308

[56] References Cited

U.S. PATENT DOCUMENTS

| | | | |
|---|---|---|---|
| 4,453,355 | 6/1984 | Stoakes | 52/235 |
| 4,543,756 | 10/1985 | Kaminaga et al. | 52/235 |
| 4,570,406 | 2/1986 | DiFazio | 52/656 |
| 4,765,107 | 8/1988 | Ting | 52/235 |

FOREIGN PATENT DOCUMENTS

| | | | |
|---|---|---|---|
| 2619587 | 8/1987 | France | 52/235 |

*Primary Examiner*—David A. Scherbel
*Assistant Examiner*—Wynn Wood
*Attorney, Agent, or Firm*—Davis, Bujold & Streck

[57] ABSTRACT

The panel comprises an outer plate (70) supported by a metal frame (71). Two opposite sides of the frame are formed by light metal profiled elements (72, 73) having a rim (74) which extends along one edge (75) of the outer surface of the plate. This rim may be bevelled or right-angled. The plate is clamped between the opposing rims (74) by means of two threaded steel rods (76). The other two edges of the panel are devoid of any metal element. The panel (62) may be placed on the front of a window (63) or an opaque part of the facade. This panel makes it possible to attach, without the use of glue, thin facade facing plates, particularly plates of glass or stone, so that they are virtually the only visible parts of the facade.

20 Claims, 7 Drawing Sheets

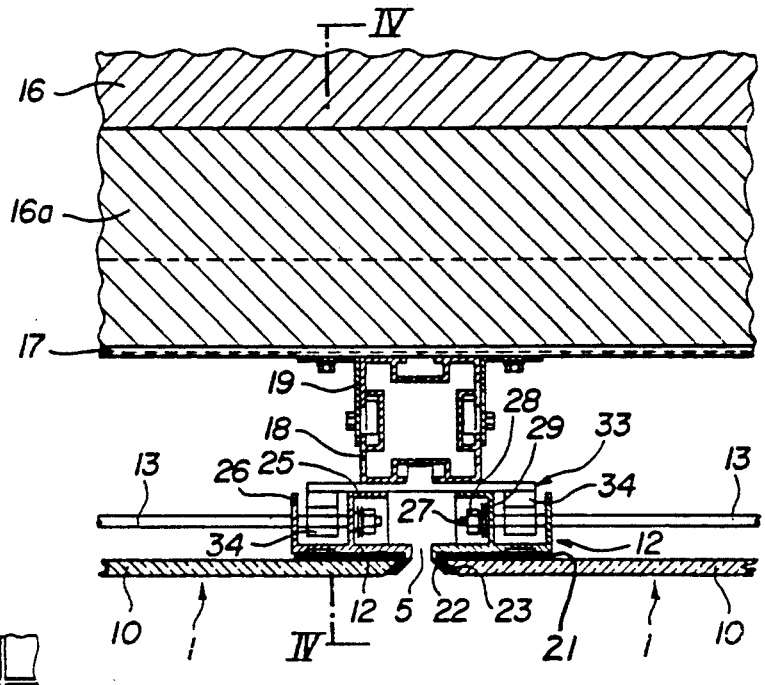
FIG. 3
FIG. 1
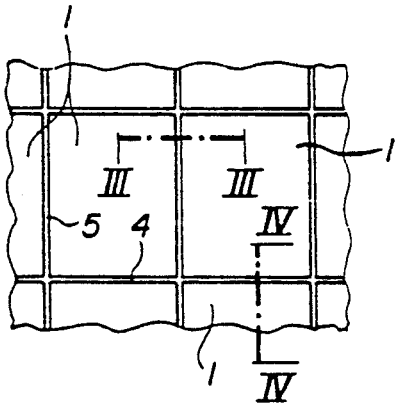
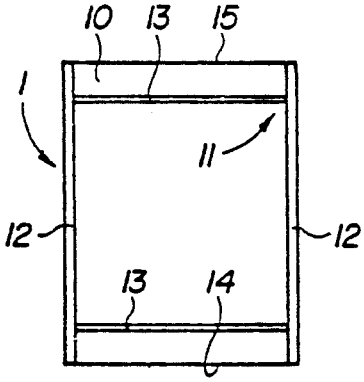
FIG. 2
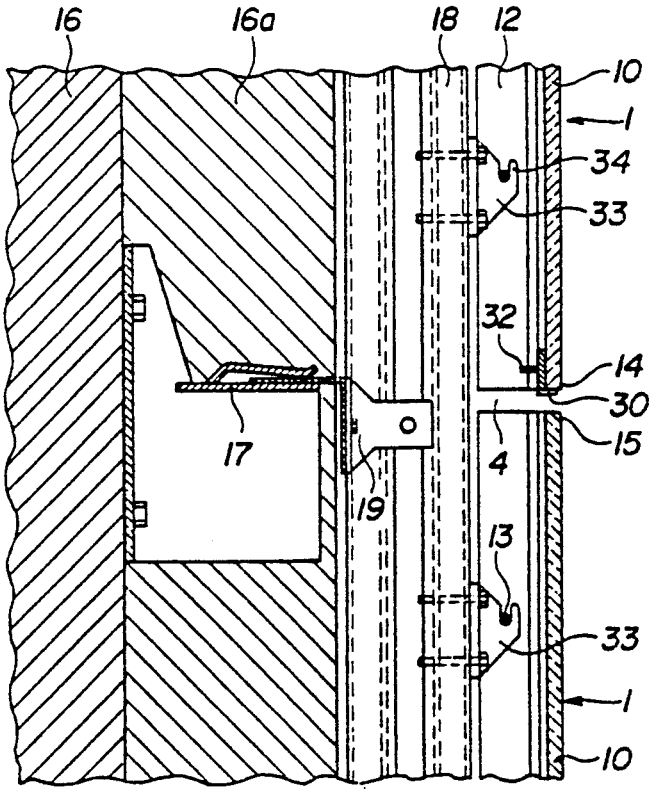
FIG. 4

METAL FRAMED FACADE PANEL AND FACADE COVERED WITH SUCH A PANEL

The present invention concerns a facing or window panel designed to form a prefabricated element of the exterior surface of a building facade and comprising at least one rectangular exterior plate, especially of glass, stone, fibro-cement, synthetic material or the like, and a metal frame supporting the said exterior plate provided with means for attaching it to a facade structure or to a window, said frame comprising metal rims hooked to at least two opposite edges of the exterior plate.

The invention also concerns a building facade covered with panels of this type.

For covering facades, the use of glass plates or thin plates made of stone or other similar materials such as fibro-cement is becoming more and more common in order to profit from their esthetic and technical properties, particularly their thermal and acoustical qualities, their durability and easy cleaning. To achieve optimal technical and esthetic results, it is desirable that the spaces between plates be as small as possible.

One known solution consists of attaching to a facade structure prefabricated panels with a metal frame to which the exterior plate is glued. Such panels with glued plates, however, have various disadvantages due to the fragility of the plate edges, the longterm unreliability of the glue, and also the difficulty of replacing a plate after eventual deterioration. For these reasons there is a tendency to abandon this solution in favor of plates with a frame having edges which hook firmly to the plate edges. For example, Patent Application GB-A-2 155 981 describes prefabricated glazed panels with a metal frame surrounding the exterior plate and a right-angled edge extending in front of the exterior surface of the glass. This edge is visible, breaks the unity of appearance on the facade and may cause a disturbing reflection. Furthermore, it interferes with cleaning the exterior plate surface.

To overcome these disadvantages, Patent Application FR-A-2 619 587 proposes a type of panel wherein the edges of the exterior plate have a bevel on the side for the building exterior. The metal frame edge covers the plate only in front of this bevel in such a way that it does not project from the flat exterior surface of this plate. Nevertheless this metal rim, which cannot be reduced indefinitely in size since it holds the plate, remains visible from the outside. Moreover, since the frame is generally made of light metal, it undergoes thermal expansion, the amplitude of which is a multiple of plate expansion. Therefore it is necessary to interpose between each rim and the plate a profiled elastomeric element which absorbs the expansion differences but increases the thickness of the visible frame portion.

Austrian Patent AT-B-379 186 describes a facade covering formed of glass plates which may have two unattached vertical edges, but they are not prefabricated panels with their own frames. The plates are supported by horizontal profiled elements which have been previously attached to the facade and which have oblique opposing rims, so that each plate may be inserted by sliding it horizontally between two opposite profiled elements and then sealed to them by means of an elastic mass.

The goal of the present invention is to overcome the disadvantages of the prior art by perfecting a panel of the type described in the preamble and reducing visible frame parts insofar as possible so as to achieve a facade on which virtually only the exterior panel plates are visible. A secondary goal consists of disposing the frame so that differential expansion between the frame and the plate is reduced.

To achieve this, the panel according to the invention is characterized in that the metal frame comprises at least one pair of support elements provided with the said rims and disposed on two opposite edges of the exterior plate, and traction elements connecting the two support elements in each pair so as to pull them toward each other and clamp the exterior plate between the said rims.

Each one of the traction elements advantageously comprises a steel rod which may have threaded extremities passing through transverse holes in the said support elements and provided with tightening screws. In another execution, the said traction elements may comprise at least one steel cable.

In a first advantageous embodiment, the panel support elements comprise two metal profiled elements disposed along two first opposite edges of the exterior plate, and at least two traction elements disposed in parallel to the two other edges of the exterior plate, said two other edges being unattached to any frame element outside the area of the plate angles. Each one of the support elements may comprise, at at least one extremity of the said profiled element, a transverse stop abutting the plate edge which is perpendicular to the said profiled element.

In another form of embodiment, the support elements of a panel comprise four angled pieces connected in twos by the traction elements, each one having two of the said edges, perpendicular to one another, for hooking onto an angle of the exterior plate, and the four edges of the said plate are unattached to any frame element between the angled portions.

The said exterior plate may be the exterior glass of double glazed insulating glass, such as that of a window.

The said exterior plate may be made of plate glass.

In a particular embodiment, one of the elements of the said pair of support elements is provided with hinges disposed to support the panel and allow it to pivot, the other element of the pair being provided with locking means to selectively block pivoting of the panel.

According to another feature, the invention concerns a building facade comprising a facade structure and an exterior facing consisting of panels such as those defined above, which are attached to said structure.

Preferably, the said support elements of the panel's metal frame are hooked at their rims onto at least two opposing vertical edges on the plate of the exterior panel and are connected by horizontally disposed traction elements, the horizontal edges of said plate being unattached to any frame element outside the area of the plate angles.

According to a particularly simple means of attachment, the said panel attachment device consists of supports attached to said structure which are provided with upwardly facing hooks to engage the traction elements of the panel frame.

In a preferred embodiment, said structure comprises a wall having at least one window, said exterior facing consists of panels of plates of glass, and these plates form a vertical screen extending in front of said wall and the window and are separated from them so as to form ventilation space between them and the screen.

In a first specific facade embodiment, the said window comprises a non-working frame and a frame opening on a vertically pivoting axis, and one of the panels of the exterior facing, situated in front of the window, is supported by the opening window frame so that it can pivot with it toward the inside of the building. Preferably, one of the said support elements on the panel frame is provided with hinges on a vertical axis, the means for attaching the panel consists of metal brackets holding said hinges and attached to the opening frame of the window, and in the area of said hinges, the panel extends in front of the non-working frame of the window so as to hide it. Said metal brackets may be angled to form, between the window and the panel, a space forming a housing for an awning.

In a second specific embodiment, one of the panels of the exterior facing, situated in front of the window, is movably attached to said structure in relation to the adjacent panels situated above and below it, said panel being movable between a first position where its glass plate is in the same vertical plane as those of the adjacent panels, and at least one second position where at least the lower edge of said plate is distances from said vertical plane and leaves an air passageway between the ventilation space and the exterior air, said panel being connected to a manual or motorized control means. The movable panel may be movable in the horizontal direction, perpendicular to the facade, while remaining parallel to itself. The said movable panel may be connected to a movable element on a deflector disposed along one lower edge of the window so that, in the movable panel's second position, the deflector extends above the ventilation space so that it can deflect a current of air in that space toward the outside.

The present invention and its advantages will be more readily apparent from the following description of various exemplary embodiments, with reference to the attached drawings, wherein:

FIG. 1 is an elevational representation of a portion of a facade covered on the outside with panels according to a first embodiment of the invention;

FIG. 2 is an elevational view of the interior surface of a facing panel for the facade of FIG. 1;

FIG. 3 is a horizontal cross-section taken along line III—III of FIG. 1;

FIG. 4 is a vertical cross-section taken along line IV—IV of FIGS. 1 and 3;

Figure 5:
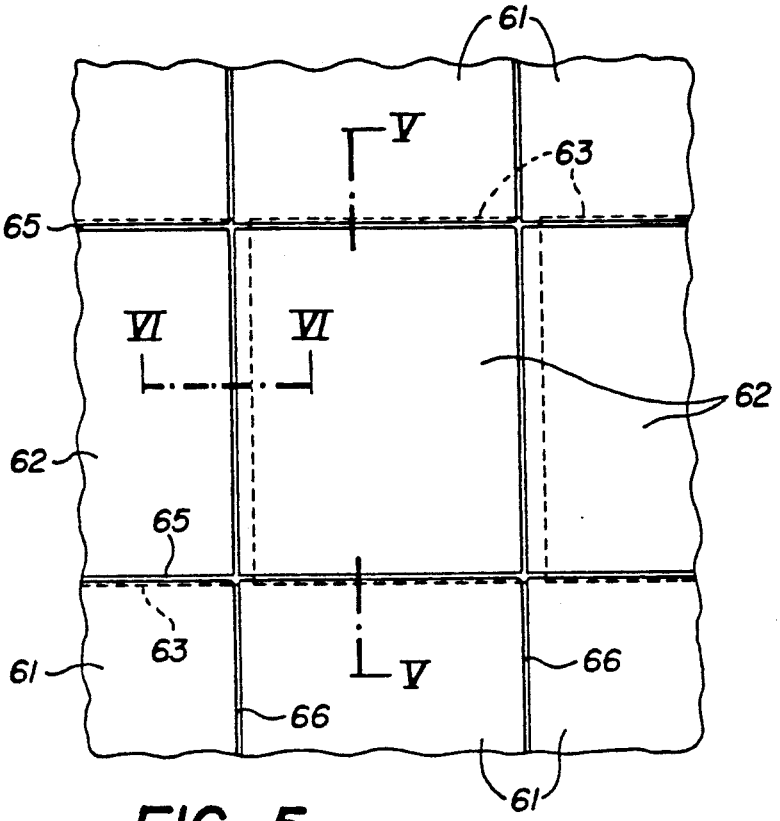
FIG. 5 is a view analogous to FIG. 1 and shows another embodiment of panels according to the invention.

FIG. 1 shows the exterior appearance of a facade covered with opaque plates, preferably of colored fibrocement, by means of prefabricated panels 1 which are attached in front of the opaque facade portions, the facade being ventilated behind these panels. Panels 1 are separated by horizontal and vertical intervals 4 and 5 forming hollow joints which are seen only as thin dark lines when one is some meters away from the facade. The exterior surface of each panel is in the same plane as that of the adjacent panels. The panel dimensions are not critical in the present invention. Specifically, depending upon the case, panel height may correspond to window height, back plate height or the height of an entire story.

FIG. 2 shows construction of panel 1 in principle, comprising an exterior plane plate 10 of fibro-cement and a metal frame 11 applied to the back of plate 10. Frame 11 is composed of two parallel support elements 12, consisting of light metal profiled elements disposed along the two vertical edges of plate 10 and provided with rims hooked onto these edges, and of two horizontal steel rods 13 forming traction elements which pull support elements 12 toward each other so as to clamp plate 10 between them. In this way, frame 11 leaves horizontal edges 14 and 15 of plate 10 unattached.

In FIGS. 3 and 4 there is shown more detail of the construction of panels 1 and how the facing they form is attached to a facade structure comprising a wall 16 covered with thermal insulation **16*a*, horizontal profiled metal elements 17 attached to the wall, and vertical profiled metal elements 18 attached to profiled elements 17 by means of angle plates 19. In each panel 1 an elastomeric strip 21 is interposed between plate 10 and each profiled element 12. This profiled element is provided with an oblique rim 22 in abutment, by the intermediary of strip 21, with the corresponding vertical edge 23 of plate 10, which is bevelled so that the plate does not slide forward, while also preventing rim 22 from extending beyond the plane of exterior surface 24 of plate 10. Profiled element 12 has two parallel flanges 25 and 26 on the side of the facade structure. Rods 13 pass through holes disposed in flanges 25 and 26. Each of their extremities is threaded and has a self-blocking screw 28 abutting flange 25, preferably by means of flexible washers 29. Screws 28 are tightened with a predetermined force which compresses plate 10 between the two opposing rims 22. With this arrangement 22, plate 10 may be held in the frame solely by friction. However, in this example, the lower extremity of each profiled support element 12 has an angle plate stop 30 with a horizontal flange engaged under the lower edge 14 of plate 10 and a vertical flange housed between profiled element 12 and plate 10 and having a horizontal peg 32 engaging in a hole in profiled element 12. This simple construction of metal frame 11 allows the conventional profiled elements covering horizontal edges 14 and 15 of exterior plates 10 to be dispensed with. These two edges do not need to be bevelled and they may be devoid of any visible element made of metal, synthetic or other material along horizontal spaces 4. Along vertical spaces 5, only the small oblique rims 22** of the frame are visible.

To support facing panels 1, metal supports 33 are attached in known manner in adjustable positions along vertical profiled elements 18. Each support 33 comprises, depending upon its position in the facade, one or two upwardly facing hooks 34. Each horizontal rod 13 in panels 1 simply engages from top to bottom in two hooks 34, each of which is inserted between flanges 25 and 26 of corresponding profiled element 12.

Aside from the esthetic advantages mentioned above, it is noteworthy that this construction of metal frame 11 allows plate 10 to be flexibly clamped in the frame thanks to the elasticity of elastomeric profiled element 21 and of washers 29, thereby eliminating any ulterior play between the frame and the plate, as well as any problem of thermal expansion differentials between the frame and the plate. Moreover, the attachment means described is extremely simple and also permits easy replacement of a damaged plate, since it is necessary only to unhook the corresponding panel and loosen screws 28 to remove plate 10 from the frame and replace it with a new one.

Figure 6:
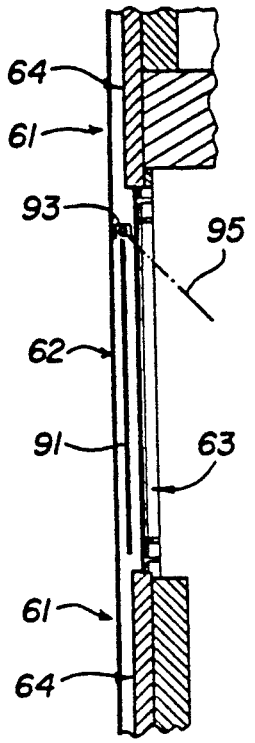
FIG. 6 is a schematic vertical cross-section taken along line VI—VI of FIG. 5.

In another form of embodiment shown in FIGS. 5 through 8, a facing or screen of glass plates is formed on a building facade by facing panels 61 and 62. As shown in FIGS. 5 and 6, each of panels 62 is attached in front of a window 63 shown by dotted lines in FIG. 5, while panels 61 are attached in front of the opaque portions 64 of the facade. Seen from the outside, panels 61 and 62 are separated by horizontal spaces 65 and vertical spaces 66 comparable to spaces 4 and 5 described above. The horizontal spaces 65 are defined only by the glass plates, and not by the rims of the panel frames.

Figure 7:
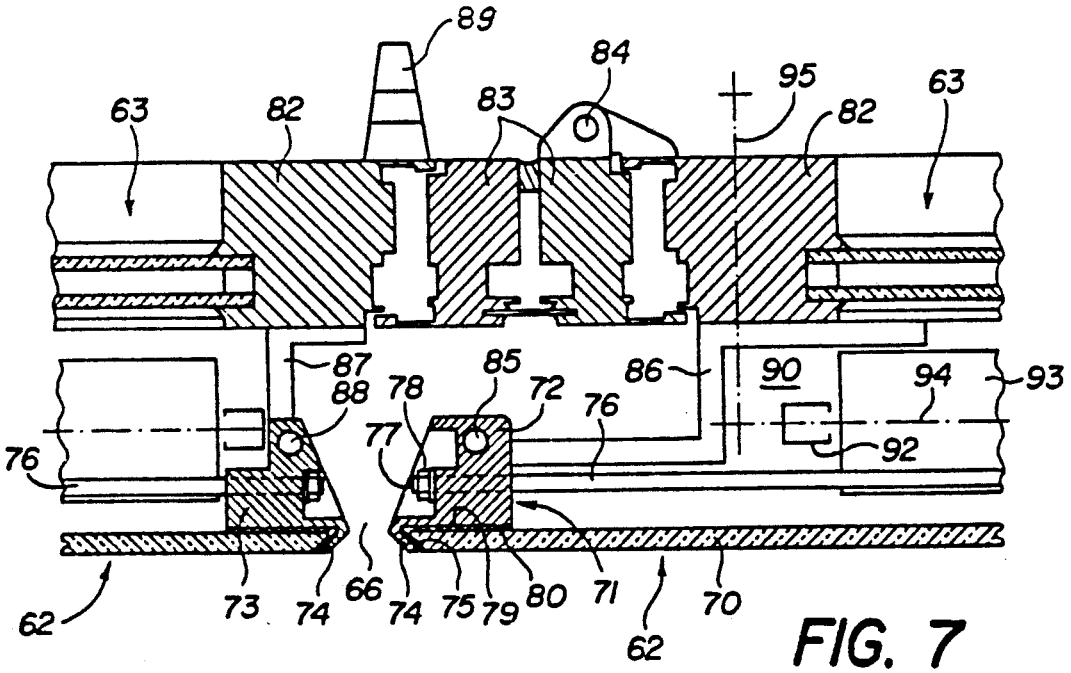
FIG. 7 is a horizontal cross-section taken along line VII—VII of FIG. 5.
Figure 8:
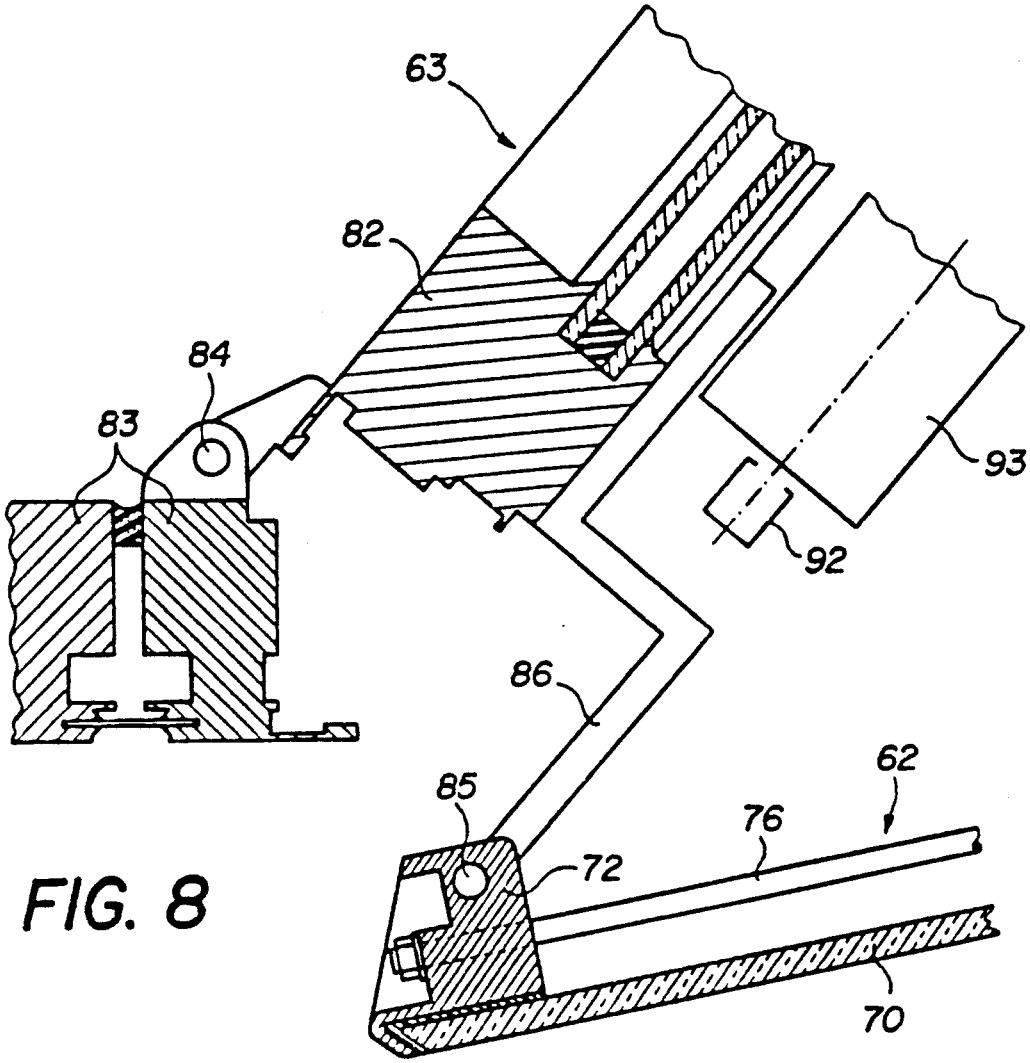
FIG. 8 shows the object of FIG. 7 in the open window position.

As is seen in FIGS. 7 and 8, each panel 62 comprises an exterior facing plate 70 made of glass, attached to a metal frame 71 formed essentially of two parallel profiled columns 72 and 73 made of light metal, each having an oblique rim 74 extending in front of a bevel 75 on a vertical edge of plate 70, and of at least two adjustable horizontal rods 76 connecting the two columns 72. Rods 76 are stainless steel and have threaded extremities 77 which pass through transverse holes in columns 72 and to which screws 78 are connected for creating a permanent traction in rods 76 ensuring that plate 70 is clamped between rims 74 of the two opposing columns 72 and 73. In the drawing it is apparent that each column 72, 73 has a flat face 79 abutting the back of plate 70. A thin connection of synthetic rubber 80 is interposed between plate 70 and the profiled column 72, 73, along surface 79 and rim 74.

The two horizontal edges of plate 70 do not need to be bevelled and may be devoid of any visible frame element. Naturally, panels 61 may have metal frames designed in the same way, so that horizontal space 65 separating the glass plates of the two superimposed panels 61, 62 is free of any attachment device and at the same time, may be very narrow and barely visible. The simple construction of metal frame 71 also resolves all the problems of expansion and tolerances in manufacturing the panels, thereby allowing the use of bevelled glass with complete security. Note that with such a system of metal framework, the facing plates may be attached by being clamped between the rims along their horizontal edges, and their vertical edges would then be devoid of attachment devices and of any metal elements.

In this example, as is shown specifically in FIGS. 6 and 7, each facing panel 62 is attached to an opening frame 82 on the window 63, and not to the non-working frame 83 supporting frame 82 by means of hinges 84 which, in the present case, have vertical axes. In actuality, column 72 of panel 62 is articulated, by the intermediary of hinges 85, to at least two metal clamps 86 attached to frame 82 of the window, while column 73 is supported by two other metal clamps 87 attached to the opposing column of frame 82. Column 73 is locked to clamps 87 by meals of sliding pegs 88 which may be displaced by pushing a recall spring (not shown) to unhook panel 62 and allow it to pivot on hinges 85 when it must be separated from window 63 for maintenance operations. As is shown in FIG. 7, this allows maintenance personnel to access panel 62 from inside the building by opening window 63 with a handle 89, then making panel 62 pivot in relation to the window while it is inside. All the glass surfaces may be cleaned from inside the building, also, including the two surfaces of exterior glass plate 70.

In FIG. 7 note that clamps 86 are long enough so that column 72 of the frame of panel 62 covering the right window is in front of the non-working frame 83 of the left window, so that vertical space 86 is situated practically opposite the vertical connection between the opening and non-working portions of the left window. This allows opaque portions 82 and 83 to be effectively hidden behind panels 62, while also allowing the right column 73 of each panel to penetrate the building when the window is opened.

In addition, FIGS. 6 and 7 show that clamps 86 and 87 are long enough in the direction perpendicular to the facade to form between each panel 62 and the corresponding window 63 a space 90 wide enough to house an awning 91 including its lateral guide rails 92 and its roller casing 93. In the drawings, the broken lines are a schematic representation of the axes 94 and 95 of a conventional awning control mechanism attached to frame 82 of the window.

Figure 9:
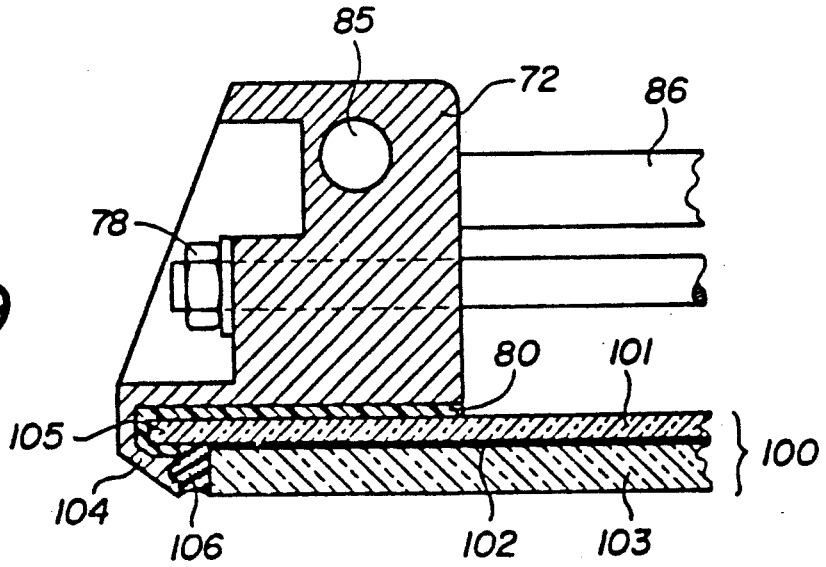
FIG. 9 is a transverse cross-section of a panel edge in another embodiment.

FIG. 9 shows an embodiment of a panel of the same type as panel 62 described above, but in which the glass plate 70 with bevelled vertical edges is replaced by a plate 100 of plate glass, comprising an interior layer of glass 101, an intermediate layer of non-tearing synthetic material 102 and an exterior layer of glass 103. Along the vertical edges of plate 100, the interior layer 101 extends beyond layers 102 and 103, thus creating a tiered shape eliminating the need for a bevel, always delicate to make. The profiled column 72 of the metal frame of the panel comprises a suitable oblique rim 104 which extends in front of projecting edge 105 of the glass layer 101, surrounded by the rubber joint 80. The extremity of rim 104 is provided with a flexible connection 106 abutting the perpendicular edge of layer 103 and ensuring that the tightening effect of screws 78 is transmitted first of all to layer 101 of the plate glass plate. Naturally, the same type of plate 100 and rim 104 may be provided on fixed panels 61 of FIGS. 5 and 6.

Figure 10:
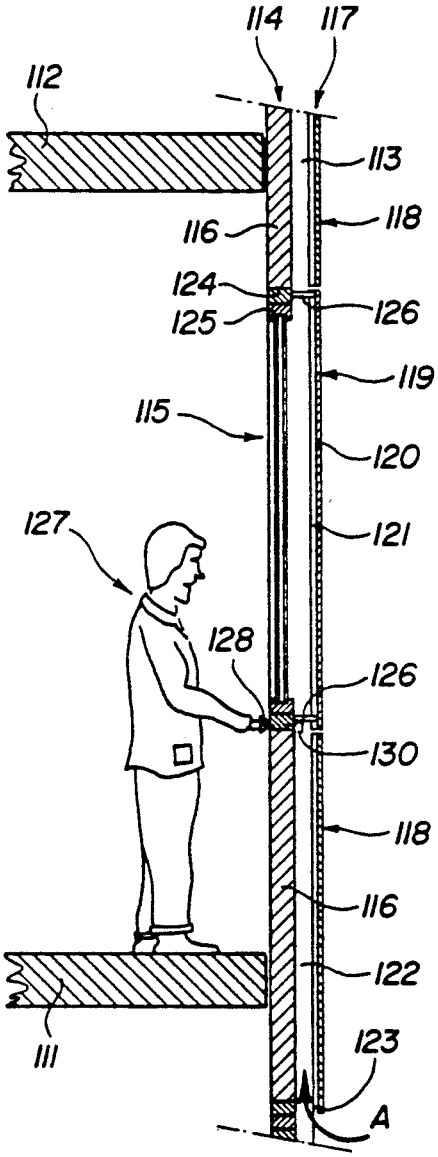
FIGS. 10 and 11 are schematic vertical cross-sections showing another embodiment of the invention in which a glass facing panel is movable between two positions respectively shown in these figures.
Figure 11:
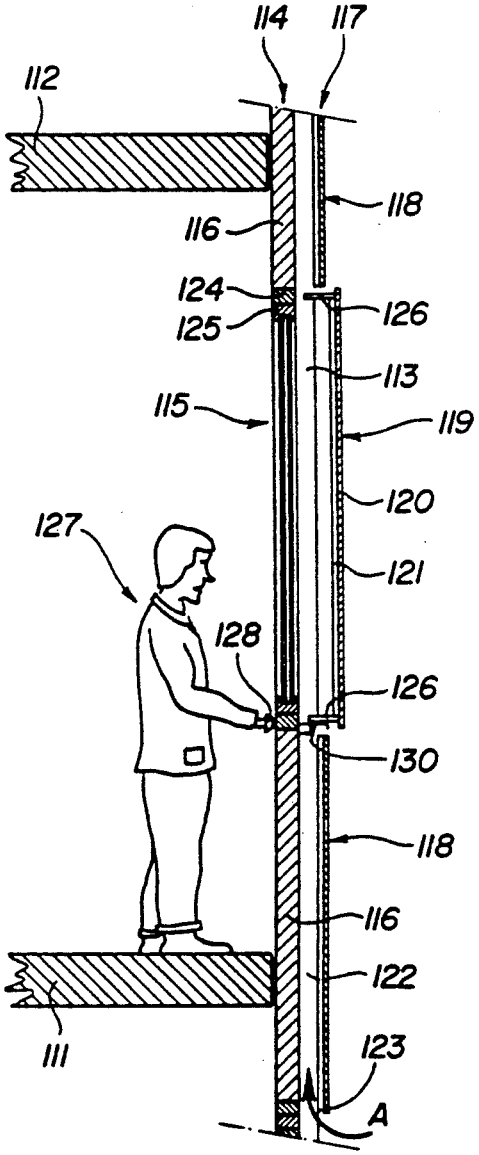

FIGS. 10 and 11 show schematically a portion of a building comprising any sort of structure, two floors 111 and 112 of which are shown, said structure supporting a facade with a metal skeleton, one vertical column 113 of which is represented schematically. A continuous wall 114 is attached to this skeleton, consisting specifically of double glazed windows 115 and opaque insulating panels 116 disposed between the different levels of windows and usually called back plates. Depending upon need, similar insulating panels are disposed between the windows on the same level. The facade is covered with a glass screen 117 forming the exterior dressing of the facade and also extending in front of both windows 115 and opaque panels 116. This screen is composed of fixed panels 118 and movable panels 119, each of which comprises an exterior plate 120 made of tinted and/or reflecting glass and a metal frame 121 disposed on the back of this plate. Frames 121 of the panels are attached to columns 113 so that a ventilation space 122 subsists between the glass plates 120 and the wall 114. Thus, the glass screen 117 ensures a certain thermal regulation effect for wall 114, by on the one hand protecting it from sunlight and, in space 122 where the air is generally hotter than outside, permitting convection circulation of air entering this space as indicated by arrow A, next to a lower edge 123 of the screen, and leaving at the next upper edge of said screen. When this heated air passes in front of a window 115, as is the case in FIG. 10, it offers the advantage of heating the window in winter; but in the summer, there is the disadvantage of overheating the area of the window where the non-working frame 124 and the opening frame 125 may be metal and thus good heat conductors. Furthermore, the current of hot air is particularly disagreeable in the summer when one opens the window.

The bothersome effects mentioned above are in large part avoided thanks to movable panel 119 preferably attached on the front of each window 115. Panel 119 is horizontally movable in a direction perpendicular to the facade, while remaining parallel to itself, between a closed position, shown in FIG. 10, and an open position, shown in FIG. 11. The panel frame is supported near its four angles by sliding arms 126 attached to columns 113 and controlled by user 127 by means of a control button 128. In addition, a deflector is formed by a movable plate 130 extending horizontally between the two lower sliding arms 126, slightly above the level of lower rim 131 of the movable panel, said plate being connected to the two arms so as to be displaceable with the panel. Its construction will be described later in more detail.

When panel 119 is in its closed position as in FIG. 10, deflector 130 is at least partially retracted and allows air to pass between it and screen 117, so that warm air can rise in front of window 115 as usual. Glass plate 120 of the movable panel is in the same plane as those of adjacent fixed panels 118. The user 127 can activate button 128 to place movable panel 119 in the open position of FIG. 11, for example if he wishes to open window 115 for air when it is hot. Deflector 130 then covers the portion of space 122 situated below the window so that the current of air rising in this space is deflected toward the outside. At the same time, outside air may be introduced behind panel 119 above deflector 130 and on the sides, to aerate the area of window 115 and/or rise in the upper portion of the ventilation space.

Figure 12:
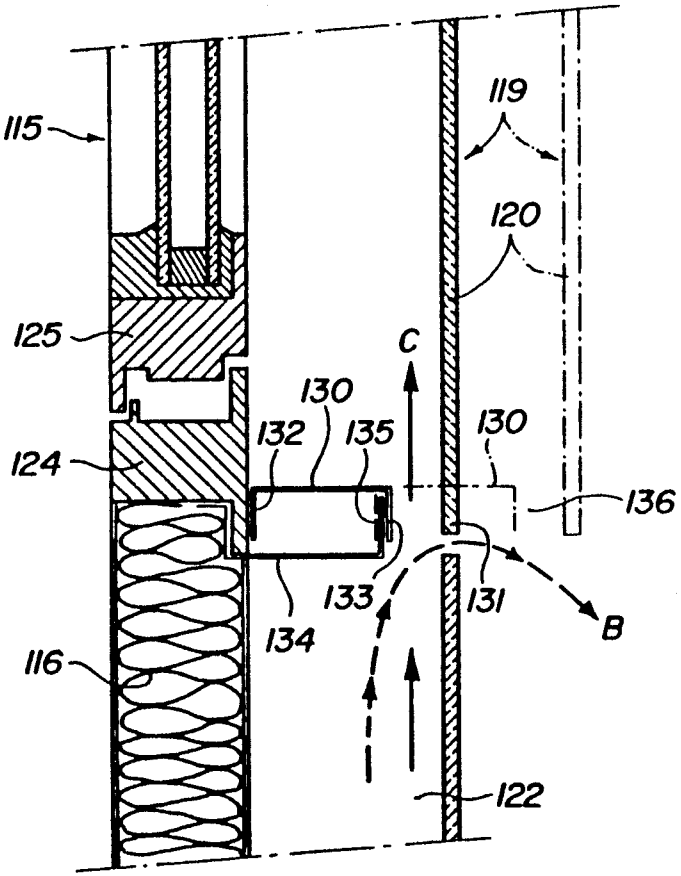
FIG. 12 is an enlarged vertical cross-section showing a portion of FIG. 10 in greater detail.

FIG. 12 shows more detail of the disposition and functioning of movable deflector element 130. This element constitutes a sort of horizontal tablet and is formed by a sheet of steel bent into a "U" with a back rim 132 and a forward rim 133 directed downward. Element 130 is located above a fixed element 134 attached to the non-working frame 124 of the window and having an ascending rim 135 situated between the two rims 132 and 133 of movable element 130. When panel 119 is in the closed position, shown by solid lines, the exterior rim 133 of movable element 130 is adjacent fixed element 134 and allows air to rise along arrow C from space 122. When panel 119 is in the open position, shown by dotted lines, movable element 130 and fixed element 134 are joined at their respective rims 132 and 135 and thus form a continuous deflector which deflects the air rising along arrow B. A space in the form of slot 136 between element 130 and glass plate 120 remains constant and in the open position may allow outside air to enter.

Figure 13:
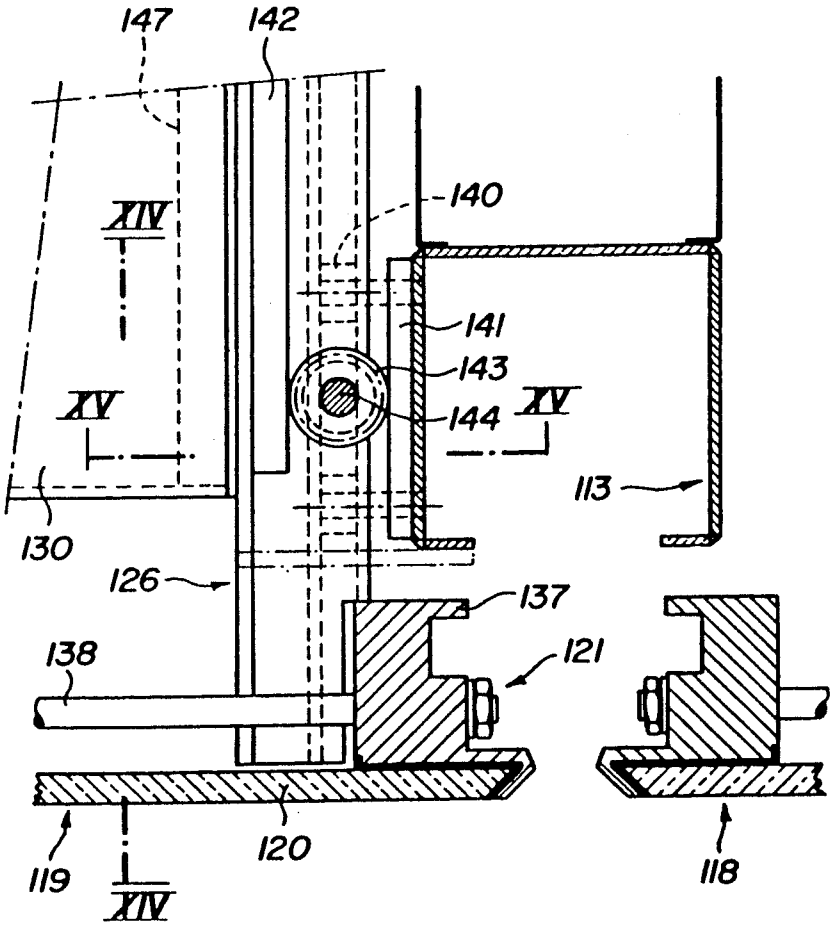
FIG. 13 is a horizontal cross-section of the detail of the area of a vertical edge of the movable panel shown in FIGS. 10 through 12.
Figure 14:
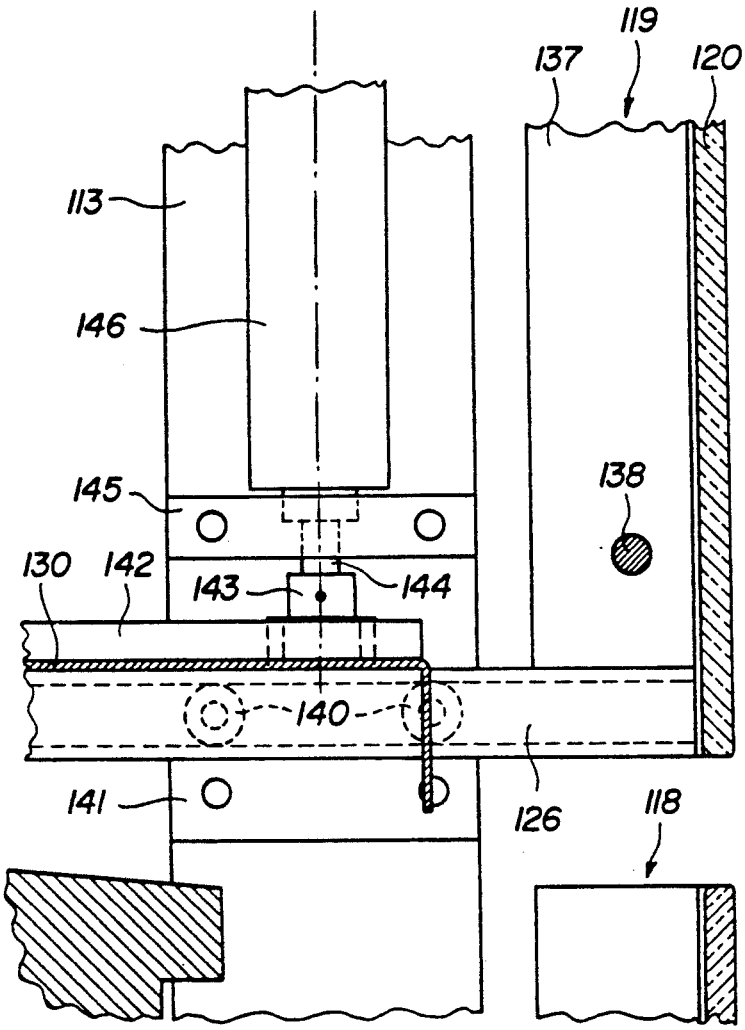
FIGS. 14 and 15 are vertical cross-sections taken along lines XIV—XIV and XV—XV of FIG. 13.
Figure 15:
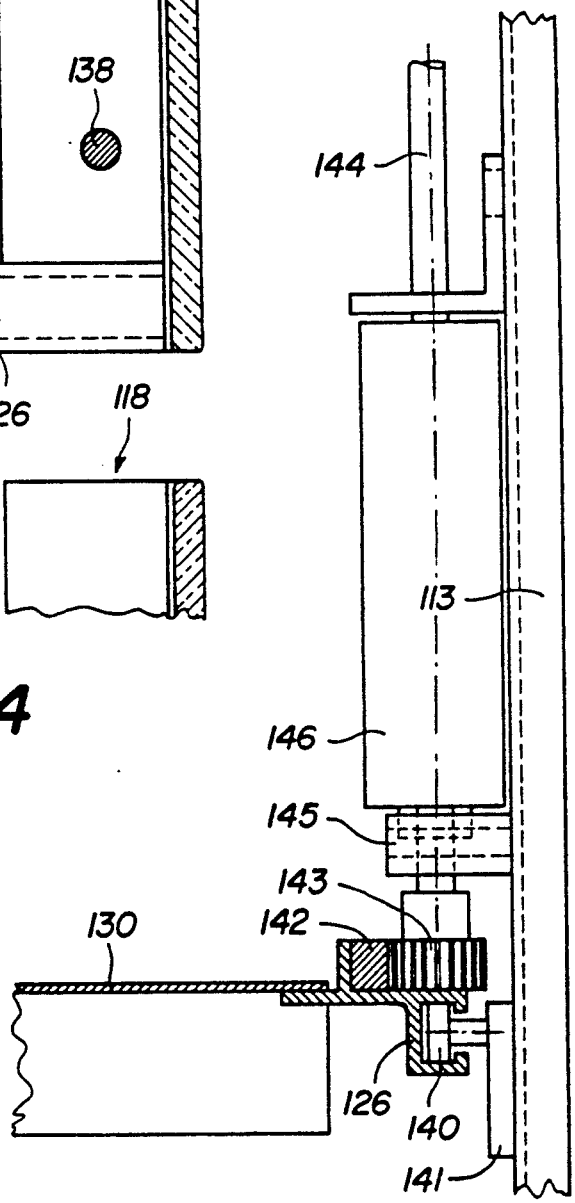

FIGS. 13 through 15 show more detail of the construction of movable panel 119 and of one of the sliding arms 126 supporting the lower portion of the panel and movable deflector element 130. Panel frame 121 is made in a similar manner to frame 11 and 71 of the preceding examples, with a pair of light metal vertical profiled elements 137, connected by two horizontal stainless steel rods 138. The rods are disposed at the level of the window frame so they do not interfere with the view. The extremities of profiled elements 137 are laterally attached to arms 126. In certain cases, a supplementary guide arm (not shown) may be provided halfway across the span of the window and attached to rod 138.

Each arm 126 consists of a light metal profiled element engaging two rotating pulleys 140 held by a support 141 attached to column 113. On this profiled element there is affixed a horizontal rack 142 on which portion 143 is engaged, supported by a rotating shaft 144 held by column 113 by means of bearings 145. Shaft 144 extends as far as the area of the top of panel 119 to drive the two arms 126 of this panel extremity in synchronization. A mechanical connection (not shown) may even be provided between arms 126 of the two panel extremities. Rotation of shaft 144 may be manually controlled. In the present case, it is effected by means of an electric motor 146 controlled from a distance with button 128 (FIG. 11). The movable element of deflector 130 is attached directly to a horizontal flange 147 of the profiled element forming arm 126.

In a facade of this type, if glass screen 117 comprises a plurality of horizontally movable panels 119 remaining parallel to themselves and controlled in synchronization, specifically in different groups of panels, an interesting visual animation effect on the facade may be attained. For example, coordinated movement of panel groups may be controlled with a computer, in combination with the control of air vents or other means acting to ventilate space 122 situated behind screen 117, or not. Note that other similar effects relating to ventilation or facade animation may be obtained by means of movable panels moving around a horizontal axis. With frame 121 described above, attaching the panel to a horizontal axis supported by a column 133 presents no difficulty.

Figure 16:
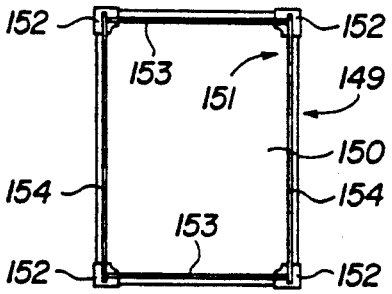
FIG. 16 is a schematic elevation of the interior surface of another facade facing panel according to the invention, having a frame formed of four angled portions connected by rods.
Figure 17:
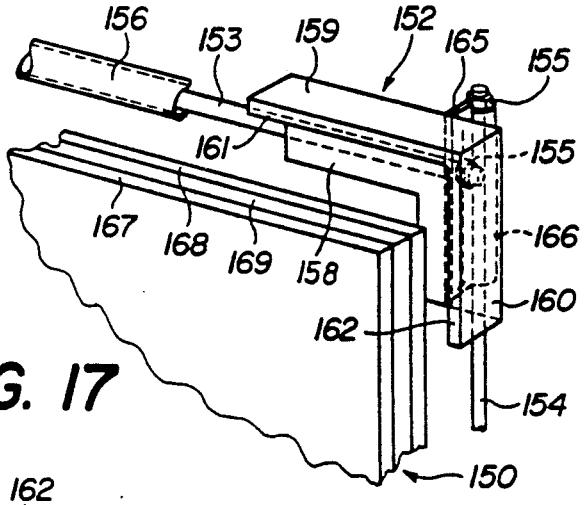
FIG. 17 shows a perspective of one of the angled portions.
Figure 18:
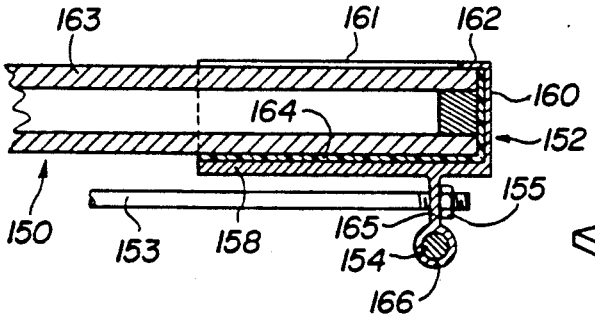
FIG. 18 is a horizontal cross-section of an angled portion of the panel of FIG. 16.

FIGS. 16 through 18 concern a panel 149 for facing a facade, comprising a rectangular exterior plate 150 and a metal frame 151 which comprises four angled pieces 152 connected in twos by traction elements, that is two horizontal rods 153 and two vertical rods 154 made of steel, preferably stainless steel. Rods 153 and 154 are similar to those of the preceding examples, with threaded extremities for holding screws 155. In certain applications they may be provided with a protective or decorative cover 156, perhaps made of synthetic material. Each angled piece 152 comprises a flat back 158 in abutment with the back of plate 150, a horizontal flange 159 and a horizontal flange 160 forming rims which cover the corresponding edges of the angle of plate 150, and rims with angle plates 161 and 162 disposed in front of flanges 159 and 160 and hooking onto the exterior surface 163 of plate 150. Preferably, an elastomeric sheet 164 is interposed between plate 150 and the corresponding surfaces of angled piece 152. In the back, back 158 of the angled piece has a vertical rib with a flat core 165 and a tubular portion 166. Core 165 is traversed by horizontal rod 153, whose screw 155 abuts the core, while tubular portion 166 receives vertical rod 154 and also serves as a contact for its screw. With such an arrangement, the horizontal and vertical edges of plate 150 may be entirely unattached to any structural elements, outside of the angled pieces of the panel. They may be located very close to the free edges of the adjacent panels, forming a facade facing which appears to be continuous. Furthermore, it is easy to block the small space between two panels by means of a prefabricated compressible connection. Another advantage of frame 151 is that it is no longer necessary to bevel the edges of plates 150 because the frame is visible on the exterior only at rims 161, 162 in the angles of the panel. If necessary, oblique rims may be provided and the plate edges bevelled only in the area of the angles.

Exterior plate 150 may be of any type whatever provided it is rigid. In this example it is a double glazed insulating one such as those used for windows, consisting of two plates of glass 167 and 168 spaced apart from each other and connected on their periphery by a connection 169 of synthetic material. This type of plate may also be used with frame 11, 71, 121 described above.

Figure 19:
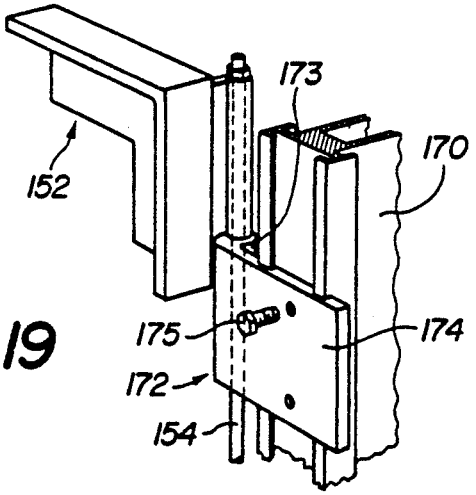
FIG. 19 is a schematic view illustrating an attachment means for the panel of FIG. 16.

FIG. 19 shows an advantageous way to affix panel 149 to vertical profiled elements 170 of a facade structure by means of supports 172 engaging vertical rods 154. Each support 172 is a profiled element of light metal or steel, having a tubular portion 173 engaging rod 154 and a flange 174, flat or profiled, attached to column 170 by means of bolts 175. Four supports 172 are sufficient to rigidly affix panel 149 to the structure, its weight being supported by contact with two upper angled pieces on upper supports 172. The panel may also be pivotably mounted around one of the vertical rods 154, thus forming a hinged axis, if suitable supports are provided for the other panel extremity. Many other types of attachment for such a panel are possible, especially by means of protruding elements on the back of each angled piece 152.

Figure 21:
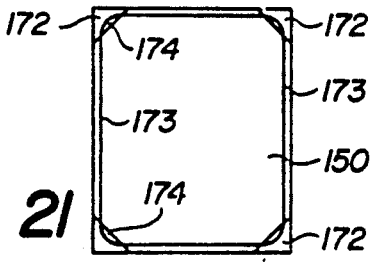
FIGS. 20 and 21 are views analogous to FIG. 16 and show two other embodiments of the panel frame.
Figure 20:
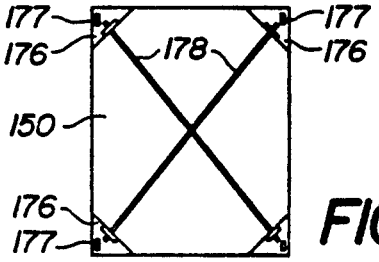

FIGS. 20 and 21 show different variations of panels similar to panel 149, but whose frames have differently designed traction elements. In the case of FIG. 20, plate 150 is supported by four angled pieces 172 which are pulled toward each other by means of one or more steel cables 173 passing over rounded projections 174 on the back of each angled piece. In this way the metal frame is nearly invisible along the edges of plate 150. The panel attachment means may be provided on projections 174 or next to them.

In the example of FIG. 21, four angled pieces 176, each provided with an attachment means 177 for attaching the panel to the facade structure are clamped onto plate 150 only by means of two diagonal steel rods 178. This solution is especially useful in a panel with an opaque facing.

Many other embodiments and ways of attaching prefabricated panels according to the present invention are possible as a function of their specific application. One important advantage of a facade constructed in this way is that the panels forming the exterior facade surface are not separated by any construction element which is conspicuous or even visible from the outside. Actually, these panels are separated only by hollow joints 4, 5, 65, 66, that is, the empty spaces which are narrow enough to be poorly lit from the outside and thus to appear as thin dark areas with an invisible base. The oblique rims of the metal frames may be colored to match the plates they support or hidden by profiled elements made of synthetic material which may be darkly colored, for example, so that from the outside of the facade virtually only the exterior plates and the dark lines formed by the hollow joints are seen. In addition to the esthetic effect, a facade covered with such panels is also advantageous from the point of view of maintenance and weather resistance, as the the structure is completely covered by the exterior panel plates. Moreover, these plates form a semi-continuous skin which allows facade ventilation behind the skin.

We claim:

1. Facing or window panel designed to form a prefabricated element of the exterior facade surface of a building and comprising at least one rectangular exterior plate (10, 70, 100), especially made of glass, stone, fibrocement, synthetic material or the like, and a metal frame (11, 71, 121, 151) supporting the said exterior plate and provided with means to attach it to a facade structure or to a window, said frame comprising at least one pair of support elements having metal rims hooked onto at least two opposing edges of the exterior plate to hold said exterior plate, and traction elements extending between the two support elements of each pair behind said exterior plate and connecting said two support elements so as to pull them forward each other and grip the exterior plate between said rims said traction elements being capable of varying the spacing between the two support elements of each pair, and at least one of the remaining edges is substantially free of any visible exterior support.

2. Panel according to claim 1, characterized in that each of the traction elements comprises a steel rod (13, 76, 138, 153, 154, 178).

3. Panel according to claim 1, characterized in that the said rod has threaded extremities (27, 77) disposed through transverse holes in said support elements and provided with clamping screws (28, 78, 155).

4. Panel according to claim 1, characterized in that the said traction elements comprise at least one steel cable (173).

5. Panel according to claim 1, characterized in that the panel support elements comprise two metal profiled elements (12, 72, 137) disposed along two first opposing edges of the exterior plate, and at least two traction elements (13, 76, 138) disposed in parallel to two other edges of the exterior plate, these two other edges (14, 15) being unattached to any frame element outside the area of the plate angles.

6. Panel according to claim 5, characterized in that each one of the support elements (12) comprises, at at least one extremity of the said profiled element, a transverse stop (30) abutting the edge (14) of the plate which is perpendicular to the said profiled element.

7. Panel according to claim 1, characterized in that the panel support elements comprise four angled pieces (152, 172, 176) connected in twos by the traction elements (153, 154, 173, 178) and each having two of the said edges (159, 160) perpendicular to each other for hooking onto an angle of the exterior plate (150), and in that the four edges of the said plate are unattached to any frame element between the angled pieces.

8. Panel according to claim 1, characterized in that the said exterior plate (150) is a double glazed insulating plate.

9. Panel according to claim 1, characterized in that the said exterior plate (100) is made of plate glass.

10. Panel according to claim 1, characterized in that one of the elements (72) of the said pair of support elements is provided with hinges (85) disposed to support the panel (62) and allow it to pivot, the other element (73) of the pair being provided with locking means (88) to selectively block the panel from pivoting.

11. Building facade comprising a facade structure and an exterior facing consisting of at least one rectangular exterior plate (10, 70, 100), especially made of glass, stone, fibro-cement, synthetic material or the like, and a metal frame (11, 71, 121, 151) supporting said exterior plate and provided with means to attach it to a facade structure said frame comprising at least one pair of support elements having metal rims hooked onto at least two opposing edges of the exterior plate to hold said exterior plate, and traction elements extending between the two support elements of each pair behind said exterior plate and connecting said two support elements so as to pull them toward each other and grip the exterior plate between said rims said fraction elements being capable of varying the spacing between the two support elements of each pair, and at least one of the remaining edges is substantially free of any visible exterior support.

12. Facade according to claim 11, characterized in that the said support elements (12, 72, 73, 137, 152) of the metal frame of a panel are hooked by their edges to at least two vertical opposing edges of the exterior plate (10, 70, 100, 120, 150) of the panel and are connected by horizontally disposed traction elements (13, 76, 138, 153), the horizontal edges of said plate being unattached to any frame element outside of the area of the plate corners.

13. Facade according to claim 12, characterized in that the said means for panel attachment comprises supports (33) attached to said structure and equipped with upwardly facing hooks (34) in which the traction elements (13) of the panel engage.

14. Facade according to claim 12, characterized in that the said structure comprises a wall having at least one window (63, 115), in that the said exterior facing is composed of panels (61, 62, 118, 119) of plates of glass, and in that these plates form a vertical screen (117) extending in front of the said wall and the window, at a distance from them, so as to form a ventilation space (122) between them and the screen.

15. Facade according to claim 14, characterized in that the said window (63) comprises a non-working frame and an opening frame on a vertical axis, and in that one (62) of the exterior facing panels, situated in front of the window, is supported by the opening frame (82) of the window so as to be able to pivot with it toward the inside of the building.

16. Facade according to claim 15, characterized in that one of the said support elements (72) of the frame of said panel (62) is provided with hinges (85) with vertical axes, in that the means for attaching panel (62) comprise metal clamps (86) supporting said hinges and affixed to the opening frame (82) of the window, and in that, in the area of said hinges, the panel (62) extends in front of the non-working frame (83) of the window so as to hide it.

17. Facade according to claim 16, characterized in that the said metal clamps (86) are angled so as to form, between the window and the panel, a space (90) forming a housing for an awning (91).

18. Facade according to claim 14, characterized in that one (119) of the exterior facing panels, situated in front of the window (115) is movably attached to said structure in relation to the adjacent panels (118) situated above and below it, said panel (119) being movable between a first position where its glass plate (120) is in the same vertical plane as those of the adjacent panels, and at least one second position where at least the lower edge (131) of said plate is distance from said vertical plane and leaves an air passageway between the ventilation space (122) and the outside air, and in that said panel is connected to a control means (128, 142–146).

19. Facade according to claim 18, characterized in that said movable panel (119) is movable in the horizontal direction, perpendicular to the facade, while remaining parallel to itself.

20. Facade according to claim 18, characterized in that the said movable panel (119) is connected to a movable element (130) of a deflector disposed along one lower edge of the window, and in that, when the movable panel is in said second position, the deflector extends above the ventilation space (122) so as to deflect a current of air rising in said interval outside.

* * * * *

UNITED STATES PATENT AND TRADEMARK OFFICE

CERTIFICATE OF CORRECTION

PATENT NO. : 5,184,440

DATED : February 9, 1993

INVENTOR(S) : Andre FELIX & Laurent FELIX

It is certified that error appears in the above-identified patent and that said Letters Patent is hereby corrected as shown below:

Column 10, line 34 replace "forward" with --toward--.

Column 11, line 27 replace "fraction" with --traction--.

Signed and Sealed this

Thirtieth Day of November, 1993

Bruce Lehman

*Attest:*

BRUCE LEHMAN

*Attesting Officer*

*Commissioner of Patents and Trademarks*